US011372437B2

(12) United States Patent
Bauer

(10) Patent No.: US 11,372,437 B2
(45) Date of Patent: Jun. 28, 2022

(54) POWER SUPPLY AND METHOD FOR SUPPLYING POWER TO A LOAD USING AN INNER ANALOG CONTROL LOOP

(71) Applicant: Advantest Corporation, Tokyo (JP)

(72) Inventor: Rudi Bauer, Böblingen (DE)

(73) Assignee: ADVANTEST CORPORATION, Tokyo (JP)

( * ) Notice: Subject to any disclaimer, the term of this patent is extended or adjusted under 35 U.S.C. 154(b) by 0 days.

(21) Appl. No.: 16/895,953

(22) Filed: Jun. 8, 2020

(65) Prior Publication Data

US 2020/0301459 A1 Sep. 24, 2020

Related U.S. Application Data

(63) Continuation of application No. PCT/EP2020/057002, filed on Mar. 13, 2020.

(60) Provisional application No. 62/817,983, filed on Mar. 13, 2019.

(51) Int. Cl.

| | |
|---|---|
| ***G05F 1/575*** | (2006.01) |
| ***G05F 1/571*** | (2006.01) |
| ***G05F 1/59*** | (2006.01) |
| ***G05F 1/46*** | (2006.01) |

(52) U.S. Cl.

CPC ..... *G05F 1/575* (2013.01); *G05F 1/468* (2013.01); *G05F 1/571* (2013.01); *G05F 1/59* (2013.01)

(58) Field of Classification Search

CPC ... G05F 1/575; G05F 1/59; G05F 1/10; G05F 1/46; G05F 1/461; G05F 1/462; G05F 1/563; G05F 1/614

See application file for complete search history.

(56) References Cited

U.S. PATENT DOCUMENTS

| | | | | |
|---|---|---|---|---|
| 4,725,940 | A * | 2/1988 | Henze | H02J 1/102 318/610 |
| 6,583,610 | B2 * | 6/2003 | Groom | H02M 3/156 323/224 |
| 7,106,033 | B1 * | 9/2006 | Liu | G05F 1/575 323/280 |
| 8,022,681 | B2 * | 9/2011 | Gurcan | G05F 1/565 323/283 |
| 8,803,501 | B2 * | 8/2014 | Kodera | G01R 31/2839 323/285 |
| 8,952,671 | B2 * | 2/2015 | Shimizu | G05F 1/575 323/283 |
| 10,627,844 | B1 * | 4/2020 | Ji | G05F 1/468 |
| 2006/0012344 | A1 * | 1/2006 | Velhner | H02P 9/305 322/23 |
| 2008/0157740 | A1 | 7/2008 | Gurcan | |
| 2009/0315484 | A1 * | 12/2009 | Cegnar | H05B 31/50 315/307 |

(Continued)

*Primary Examiner* — Gustavo A Rosario-Benitez

(57) ABSTRACT

A power supply comprises an output stage configured to provide a supply current, in order to obtain a supply voltage. The power supply also comprises a digital regulator configured to receive a reference voltage information and a measured voltage information and to provide a control signal. The power supply further comprises an inner analog control loop, wherein the inner analog control loop is configured to provide an analog feedback signal, which is based on the supply voltage, to the output stage, to make an analog regulation contribution to a regulation of the supply voltage. A method for supplying power to a load is also disclosed.

17 Claims, 4 Drawing Sheets digital control with an inner analog loop

(56) References Cited

U.S. PATENT DOCUMENTS

| | | | | |
|---|---|---|---|---|
| 2009/0316743 | A1* | 12/2009 | Alfrey | H01S 5/042 372/38.04 |
| 2014/0185158 | A1* | 7/2014 | Li | G11B 5/6011 360/39 |
| 2014/0253071 | A1* | 9/2014 | Hammerschmidt | G05F 1/59 323/280 |
| 2018/0120879 | A1* | 5/2018 | Du | G05F 1/575 |
| 2018/0284823 | A1* | 10/2018 | Na | G05F 1/575 |

* cited by examiner digital control with an inner analog loop

POWER SUPPLY AND METHOD FOR SUPPLYING POWER TO A LOAD USING AN INNER ANALOG CONTROL LOOP

CROSS-REFERENCE TO RELATED APPLICATIONS

This application is a continuation of co-pending International Application No. PCT/EP2020/057002, filed Mar. 13, 2020, which is incorporated herein by reference in its entirety, which claims priority to U.S. Provisional Application 62/817,983 entitled "Load Step Improvement For Digital Control Loop Based DUT Power Supply," filed Mar. 13, 2019, and hereby incorporated by reference in its entirety.

1. BACKGROUND

Embodiments according to the present invention are related to a power supply.

Further embodiments according to the invention are related to a method for supplying power to a load.

Generally, embodiments according to the invention are related to a load step improvement for digital control loop based device-under-test (DUT) power supplies.

2. BACKGROUND OF THE INVENTION

Power supplies, or regulated power supplies, are applied in many technical applications. For example, regulated power supplies are used in most electrical apparatuses, like computers, multimedia devices, and so on. Furthermore, regulated power supplies are also used in electrical laboratory environments in which, typically, particularly high requirements are set.

Moreover, regulated (or controlled) power supplies are typically also used in automated test equipment in order to provide one or more supply voltages for the device under test (or even for multiple devices under test). For example, in automated test equipment it is often desirable to program the supply voltage in a test program and to perform tests at different supply voltages. Also, it is typically desirable to have a very well-defined and stable supply voltage in automated test equipment, in order to be able to reliably characterize a device under test.

In the following, some conventional solutions will be described.

For example, conventional solutions use digital control loop based VI sources (for example, voltage-current sources) or a DUT power supply using a single control loop.

However, in view of the prior art, there is a desire to have a power supply concept which provides for an improved tradeoff between load step behavior, accuracy and implementation effort.

3. SUMMARY OF THE INVENTION

An embodiment according to the invention creates a power supply (for example, for use in automated test equipment), comprising an output stage configured to provide a supply current, in order to obtain a supply voltage. For example, the output stage provides a supply current, e.g., to a device under test, on the basis of a control signal. The power supply further comprises a digital regulator configured to receive a reference voltage information (e.g., a digital information describing a desired supply voltage, e.g., SV) and a measured voltage information (e.g., an output of an analog-to-digital converter which analog-to-digital converter converts a signal which is based on the actual supply voltage) and to provide a control signal (e.g., for the output stage or, generally, for controlling the output stage). Moreover, the power supply also comprises an inner analog control loop, wherein the inner analog control loop is configured to provide an analog feedback signal, which is based on the supply voltage, to the output stage, to make an analog regulation contribution to a regulation of the supply voltage. Accordingly, the regulation of the supply voltage may be a combined analog and digital regulation, wherein one contribution comes from the digital regulator and wherein one contribution comes from the inner analog control loop.

This embodiment according to the invention is based on the finding that an inner analog control loop may be helpful to improve a load step behavior while keeping the implementation effort reasonably small. In particular, by combining a digital regulator with an inner analog control loop, a high regulation accuracy can be reached even using a low complexity analog control circuitry for the implementation of the inner analog control loop, since the digital regulator can typically be used to implement a high precision regulation using a comparatively slow regulation approach or regulation algorithm, while the inner analog control loop implements a comparatively fast regulation with a reduced accuracy. To conclude, the combination of a digital regulator and of an inner analog control loop allows for a fast load step behavior, which is mainly due to a comparatively fast and low complexity inner analog control loop, and at the same time allows for a high regulation accuracy mainly due to the typically comparatively slower and more complex digital regulator. The digital regulator may apply a regulation approach or regulation algorithm which can be efficiently adapted to the specific need of the respective application environment. For example, the inner analog control loop may counteract a change of the supply voltage in response to a load step even before the digital regulator responds to the load step. Thus, within a limited temporal environment after the load step, a response of the inner analog control loop may be significantly stronger (for example, at least five times stronger or at least ten times stronger) than a response of the digital regulator.

Moreover, it should be noted that the addition of the inner analog control loop is typically also significantly easier to implement (and cheaper) than a (substantial) acceleration of the digital regulator (e.g., including the required analog-to-digital converter and the required digital-to-analog converter) which would bring a comparable improvement of the load step response of the power supply.

To conclude, the power supply as discussed herein, which combines the usage of a digital regulator and of an inner analog control loop, brings along an improved tradeoff between implementation efforts (or, equivalently, costs), regulation accuracy and load step behavior.

In a preferred embodiment a bandwidth of the inner analog control loop is larger, at least by a factor of 5, or at least by a factor of 10, or at least by a factor of 20, than a bandwidth of the digital regulator (wherein, for example, the bandwidth of the digital regulator may be 50 kilohertz, or may be of an order of a magnitude of 50 kilohertz).

However, by choosing the bandwidth of the inner analog control loop to be significantly larger than the bandwidth of the digital regulator, the load step behavior can be significantly improved over a power supply which only comprises a digital regulator. Moreover, it has been found that the implementation of an inner analog control loop, which has a bandwidth that is significantly larger than the bandwidth of the digital regulator, is typically possible with moderate implementation effort. Accordingly, the easy to implement and fast inner analog control loop can significantly improve the load step behavior without excessively increasing the implementation costs.

In a preferred embodiment, a bandwidth of the inner analog control loop (e.g., 500 kilohertz to 1 megahertz) is higher than at tenth of a sampling rate (e.g., 2 megahertz or 2 Msps) of an analog-to-digital converter which provides the measured voltage information for the digital regulator. By having such a high bandwidth of the inner analog control loop, which can typically be implemented with moderate effort, it can be achieved that the inner analog control loop reacts faster to a load step than the digital regulator. In other words, by an appropriate choice of the bandwidth of the inner analog control loop, it can be achieved that a short-term (instantaneous) response of the inner analog control loop is stronger than a short term response (shortly after a load step) of the digital regulator. Thus, the inner analog control loop can improve the load step behavior without a typically more costly increase of a speed of the digital regulator (which may typically also require an increase of a sampling rate of an analog-to-digital converter which provides the measured voltage information for the digital regulator).

In a preferred embodiment, the inner analog control loop is configured to perform a proportional control (i.e., act as a proportional controller). This may, for example, imply that the analog control loop is comparatively fast (for example, faster than an integral control), but typically leaves a control error even in a steady state. In other words, the inner analog control loop may, for example, be configured to perform a pure proportional control. Moreover, the digital regulator may be configured to perform a closed loop control which comprises an integral control (wherein the integral control may, for example, be comparatively slower than the inner analog control loop but may reduce a control error in a steady state to a smaller value than the inner analog control loop). It has been found that a proportional control can be implemented with small effort but higher speed, and that the proportional control is well suited to counteract supply voltage fluctuations (e.g., supply voltage drops or supply voltage peaks) that result from load steps. On the other hand, a more elaborate control, which comprises an integral control, can be implemented with moderate effort in the digital regulator and typically provides the desired high steady-state accuracy of the supply voltage.

In a preferred embodiment, a control mechanism (e.g., a control algorithm) of the digital regulator is reconfigurable (for example, in terms of time constants and/or gains, e.g. of the control sub-functions, like proportional control, integral control and/or differential control). In other words, the functionality of the digital regulator can be adapted to the specific needs of the specific application environment, which would be very difficult in the presence of a fully analog regulation. On the other hand, it is typically not necessary to change the characteristics of the inner analog control loop, since the inner analog control loop is mainly responsible for the handling of load steps. Consequently, it is possible to use a simple non-configurable analog circuit for the implementation of the inner analog control loop, which saves implementation effort, while maintaining a desired degree of adaptivity using a reconfigurable digital regulator. Thus, a good compromise between implementation effort and regulation characteristics can be achieved.

In a preferred embodiment, the inner analog control loop is configured to reduce or limit or counteract a load step caused by a change of a current consumption of a load coupled to the power supply before the digital regulation becomes effective (or takes action) (for example to also reduce or limit or counteract the load step). By using such a fast inner analog control loop, it is possible to have a very good load step behavior while avoiding the need to implement a very fast digital regulation. Consequently, a good tradeoff between implementation effort and regulation result can be achieved.

In a preferred embodiment, the inner analog control loop is configured such that a drop of the supply voltage (which may, for example, be caused by a fast increase of a current consumption of a load coupled to the power supply before the digital regulation becomes effective) results in an increase of the supply current. In other words, the inner analog control loop may be configured such that it counteracts (for example, by appropriately effecting a drive signal of power semiconductors of the output stage) changes (for example, a drop) of the power supply voltage. Thus, the inner analog control loop can counteract abrupt changes of the supply voltage in an efficient manner and typically much faster than the digital regulator.

Consequently, excessive abrupt changes of the supply voltage can be avoided with moderate effort, which makes the power supply suitable for use in test equipment.

In a preferred embodiment, the inner analog control loop comprises a feedback of the supply voltage, or of an analog signal which is based on the supply voltage (e.g., a scaled version of the supply voltage) to the output stage. By feeding back the supply voltage, or an analog signal which is based on the supply voltage, to the output stage, the closed loop control, which is enabled by the inner analog control loop, can react to supply voltage changes very fast. For example, a control amplifier (e.g., a difference amplifier or an operational amplifier), which forms the regulator of the inner analog control loop, may be part of the output stage, which typically results in a very low delay of the inner analog control loop. Said control amplifier may, for example, also consider a control signal provided by the digital regulator to thereby obtain a drive signal for a power element (e.g., a power semiconductor) of the output stage which provides a supply current for a load.

In a preferred embodiment, the inner analog control loop comprises a subtraction (e.g., an analog subtraction) between a control signal provided by the digital regulator and a feedback signal, which represents the supply voltage (wherein the feedback signal, which represents the supply voltage may, for example, be equal to the supply voltage or may be based on the supply voltage) in order to obtain a drive signal for the output stage (e.g., a drive signal for one or more power semiconductor devices which provide the supply current). For example, by subtracting the feedback signal from the control signal provided by the digital regulator, the drive signal for the one or more power semiconductor devices may be obtained in a very efficient manner. For example, the subtraction may be performed by a control amplifier or by an operational amplifier, wherein a gain of this differential amplifier or operational amplifier may be adapted appropriately, for example, to have a stable control loop, a sufficient bandwidth and an appropriate regulation accuracy and characteristic.

In a preferred embodiment, the power supply also comprises a feedback path for the digital regulator, a digital-to-analog converter configured to obtain an analog control signal on the basis of a digital control information provided by the digital regulator, and an analog regulator (e.g., a difference amplifier or an operational amplifier), which is configured to receive the analog control signal provided by the digital-to-analog converter and an analog feedback signal which represents the supply voltage, and to provide a drive signal for the output stage on the basis of the analog control signal provided by the digital-to-analog converter and the analog feedback signal. It has been found that such a circuit structure allows for a particularly good regulation. A digital regulation loop comprises the feedback path for the digital regulator (which may be different from a feedback path for the inner analog control loop, or which may partially overlap with the inner analog control loop), the digital regulator and a digital-to-analog converter that obtains the analog control signal. Moreover, the analog feedback signal and the analog control signal provided by the digital-to-analog converter may be combined in the analog regulator, to obtain a drive signal for power components (e.g., semiconductor devices) of the output stage.

Thus, the structure described herein may allow for a simple implementation of a multi-loop regulation which comprises both a digital control loop and an inner analog control loop. Using the analog control signal (which is based on the digital regulation) and the analog feedback signal (which is provided via the inner analog control loop), the specific advantages of both the digital regulation and the analog regulation can be combined with moderate effort, wherein a combination of the analog control signal and of the analog feedback signal in the analog regulator may result in a high bandwidth of the analog regulation (or, equivalently, in small latencies of the analog regulation).

In a preferred embodiment, the feedback path for the digital regulator comprises an analog-to-digital converter and a filter (e.g., a low pass filter). The filter (e.g., low-pass filter) is coupled between a load connection (at which the supply voltage is provided to a load) and an input of the analog-to-digital converter. Accordingly, a digital feedback information for the digital regulator is obtained, wherein, for example, a bandwidth of the signal input into the analog-to-digital converter is limited, for example, in view of the limited sampling rate of the analog-to-digital converter, to thereby avoid aliasing.

In a preferred embodiment, the feedback path for the digital regulator comprises a buffer, which is coupled between the load connection and the filter. Accordingly, a decoupling can be achieved, and the load remains substantially unaffected by the feedback path.

In a preferred embodiment, the power supply further comprises a shunt resistor for a current measurement, which is coupled between the output stage and a load connection (at which the supply voltage is provided to a load). The shunt resistor thus allows for a current measurement but may also provide some parasitic voltage drop, in particular in the case of a load step, which, however, can be reasonable compensated by the inner analog control loop. Thus, it can be achieved that the presence of the shunt resistor does not significantly degrade the load step behavior.

An embodiment according to the invention creates a method for supplying power to a load using a power supply comprising a digital regulator and an inner analog regulation loop. For example, the power supply may comprise an output stage (which, for example, provides a supply current, e.g., to a device under test, on the basis of the control signal) configured to provide a supply current, in order to obtain a supply voltage, a digital regulator configured to receive a reference voltage information (e.g., digital information describing a desired supply voltage, e.g., SV) and a measured voltage information (e.g., an output of an analog-to-digital converter which analog-to-digital converts a signal which is based on the actual supply voltage) and to provide a control signal for the output stage, and an inner analog control loop, wherein the inner analog control loop is configured to provide an analog feedback signal, which is based on the supply voltage, to the output stage, to make an analog regulation contribution to a regulation of a supply voltage (wherein the regulation of the supply voltage is a combined analog and digital regulation, wherein one contribution comes from the digital regulator and wherein one contribution comes from the inner analog control loop). The method comprises at least partially compensating drops or peaks of a supply voltage, which are caused by a load change, using the inner analog control loop using a first time constant and fine-regulating the supply voltage using the digital regulation using a second time constant. The first time constant is smaller, for example at least by a factor of 5, than the second time constant.

This method is based on the same considerations as the above mentioned power supply. In particular, the method allows for a good tradeoff between implementation complexity, regulation accuracy and load step behavior. The combination of an inner analog control loop and of a digital regulation helps to quickly react to a load change while still achieving an excellent steady state regulation accuracy, without the need for an excessively expensive high speed digital regulation (wherein it should be noted that analog-to-digital converters having both a very high accuracy and a high sampling rate are typically very costly). Thus, by distributing the different functionalities, namely the fast reaction to a load step and the accurate regulation of a steady state, to two different components having different regulations speeds, namely to the inner analog control loop and to the digital regulation, a particularly good overall functionality can be achieved with moderate implementation effort.

However, it should be noted that the method described here may optionally be supplemented by any of the features, functionalities and details disclosed herein, also with respect to the power supply. It should be noted that the method may optionally be supplemented by such features, functionalities and details both individually and taken in combination.

4. BRIEF DESCRIPTION OF THE FIGURES

Embodiments according to the present invention will subsequently be described taking reference to the enclosed figures in which.

5 DETAILED DESCRIPTION OF THE FIGURES

5.1. Power Supply According to FIG. 1

Figure 1:
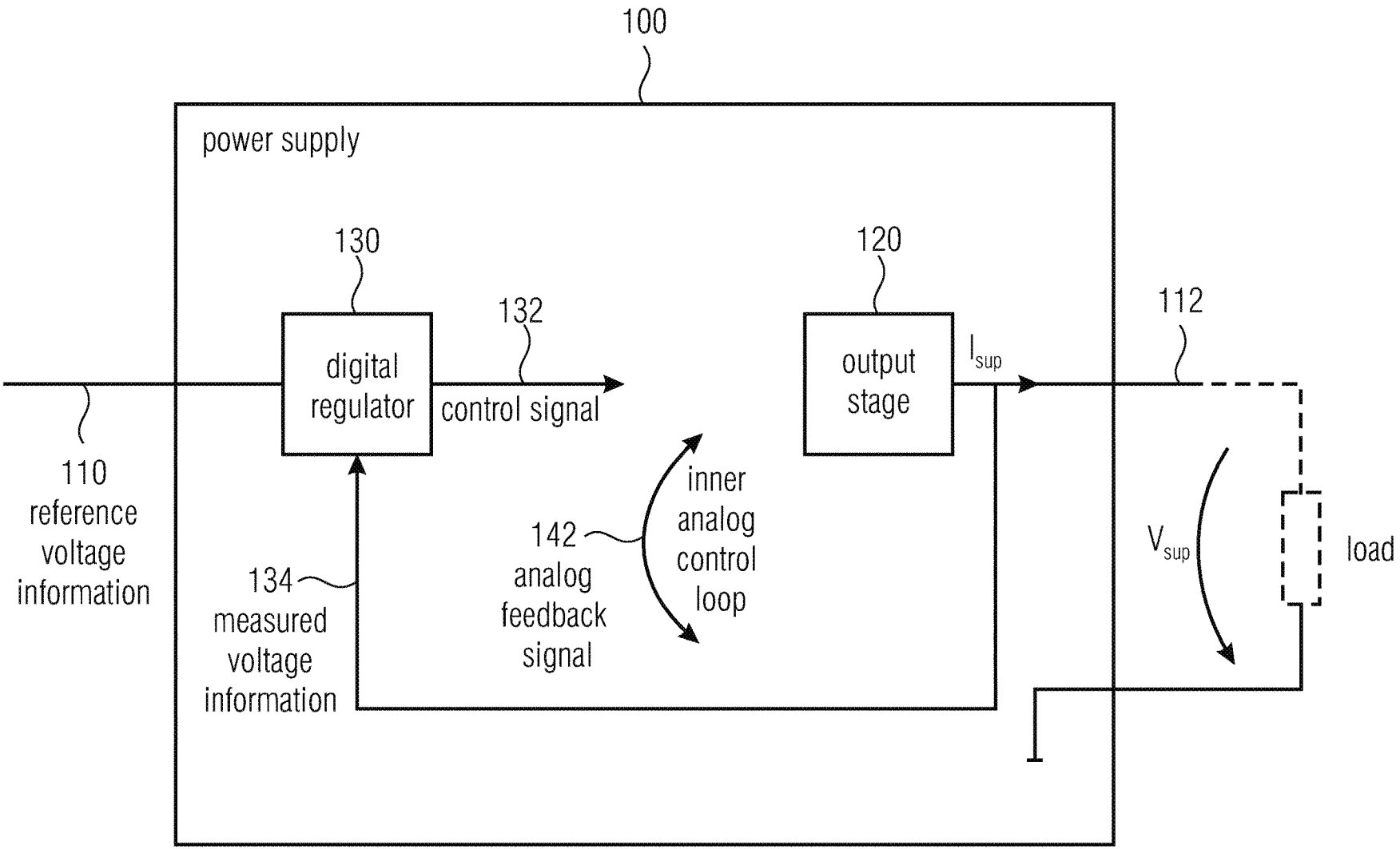
FIG. 1 shows a block schematic diagram of a power supply, according to an embodiment of the invention.

FIG. 1 shows a block schematic diagram of a power supply 100, according to an embodiment of the present invention.

The power supply 100 is configured to receive a reference voltage 110 and to provide, on the basis thereof, an output current $I_{sup}$ or, equivalently, an output voltage $V_{sup}$ at a load connection 112 (wherein a load may be coupled to the power supply at the load connection). The power supply comprises an output stage 120, where the output stage 120 provides a supply current $I_{sup}$, in order to obtain a (desired) supply voltage $V_{sup}$. The output stage 120 may, for example, provide the supply current $I_{sup}$ in dependence on a control signal 132, which is provided by a digital regulator 130, and in dependence on an analog feedback signal 142, which is provided via an inner analog control loop. The digital regulator 132 is configured to receive the reference voltage information 110 (e.g., a digital information describing a desired supply voltage, e.g., SV) and a measured voltage information 134 (e.g., an output of an analog-to-digital converter which analog-to-digital converts a signal which is based on the actual supply voltage $V_{sup}$). Moreover, the digital regulator 130 is configured to provide the control signal 132. The inner analog control loop is configured to provide the analog feedback signal 142 to the output stage, to make an analog regulation contribution to a regulation of the supply voltage. For example, the analog feedback signal may be based on the supply voltage $V_{sup}$.

Accordingly, the regulation of the supply voltage $V_{sup}$ is a combined analog and digital regulation, wherein one contribution comes from the digital regulator 130 and wherein one contribution comes from the inner analog control loop. For example, both an analog representation of the control signal 132 and the analog feedback signal 142 may be fed to the output stage, wherein the output stage 120 may consider both the analog representation of the control signal 132 and the analog feedback signal 142 for an adjustment of the current $I_{sup}$. For example, a difference between the analog representation of the control signal 132 and the analog feedback signal 142 may be considered by the output stage 120 for the adjustment of the supply current $I_{sup}$.

In the power supply 100, both the inner analog control loop and the digital regulator 130 support the regulation of the supply voltage $V_{sup}$, wherein the inner analog control loop typically provides a faster response to a load step, and wherein the digital regulator 130 typically provides a more precise regulation of a steady state supply voltage. However, it has been found that the combination of a digital regulator and of an inner analog control loop constitutes a cost efficient way to improve an overall regulation behavior.

Typically, the inner analog control loop comprises better regulation characteristics in case of a load step, while the digital regulator comprises better regulation characteristics for a regulation of a steady state supply voltage.

However, it should be noted that the power supply 100 may optionally be supplemented by any of the features, functionalities and details disclosed herein.

Figure 2:
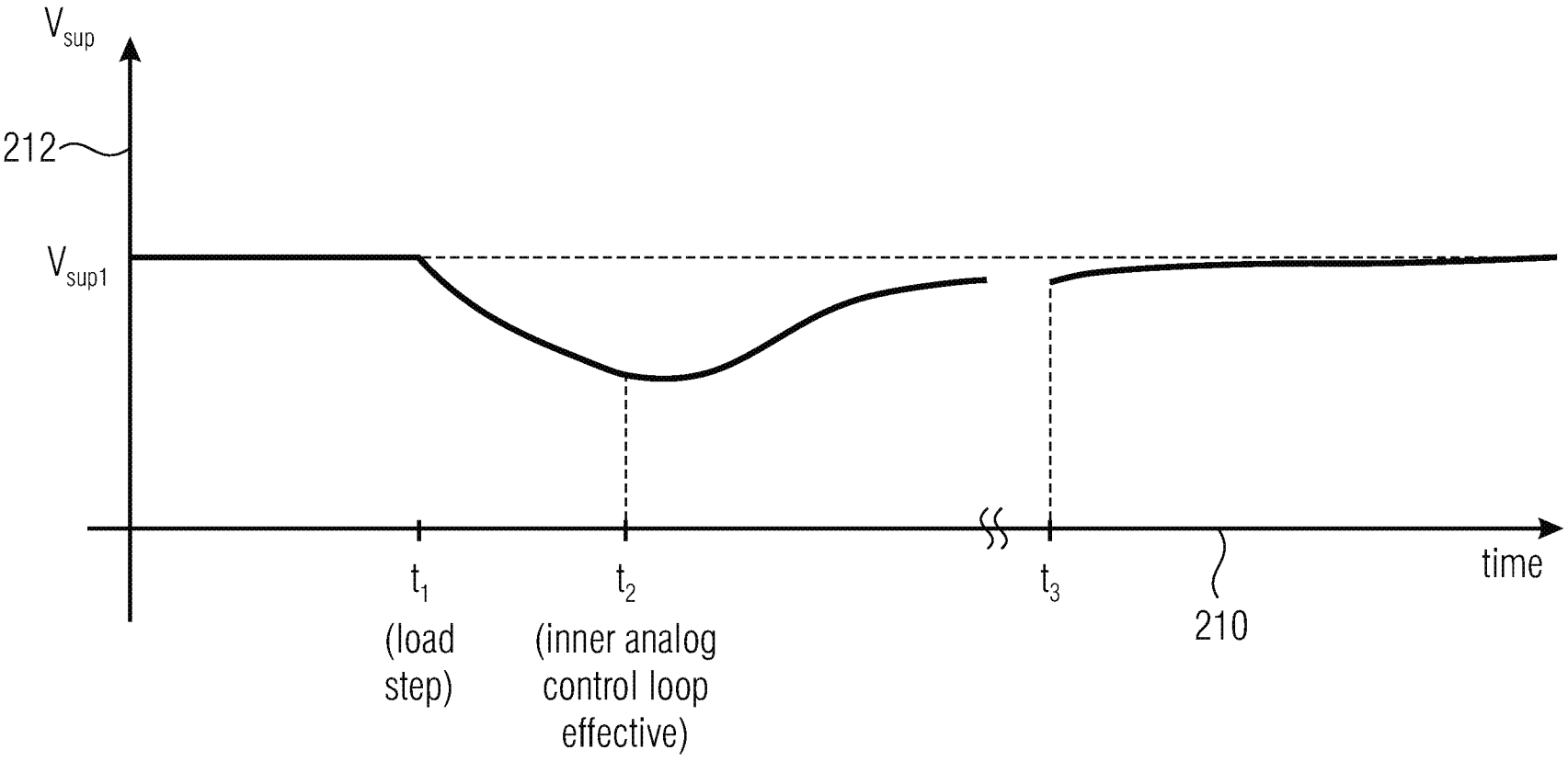
FIG. 2 shows a schematic representation of a regulation functionality, which may be achieved by an embodiment of the present invention.

In the following, an example of a regulation characteristic, which may be achieved by the power supply 100, will be described taking reference to FIG. 2. FIG. 2 shows a schematic representation of a temporal evolution of the supply voltage $V_{sup}$ over time. An abscissa 210 describes the time, and an ordinate 212 describes the supply voltage $V_{sup}$. As can be seen in FIG. 2, the supply voltage $V_{sup}$ initially takes a value $V_{sup1}$. However, at a time $t_1$ there is a load step, which means that the load coupled to the load connection 112 increases the load current. For example, the increase of the load current may be abrupt or step-wise. In response to the load step, the supply voltage $V_{sup}$ decreases, wherein a speed of the decrease may be limited, for example, by one or more capacitances which are coupled in parallel to the load. These capacitances, which are coupled in parallel to the load, may either be part of the power supply 100, or may be external components. However, at a time $t_2$, the inner analog control loop may become effective, and may counteract a further reduction of the supply voltage. For example, the inner analog control loop may provide a feedback to the output stage, to thereby increase the supply current $I_{sup}$. For example, the feedback via the inner analog control loop may have the effect that a drive signal of power devices of the output stage, which may provide (or deliver) the supply current $I_{sup}$, is increased. Accordingly, the supply current $I_{sup}$ is also increased with respect to a previous state, and the output stage 120 therefore counteracts the drop of the supply voltage $V_{sup}$. Accordingly, it can be seen that, at a time $t_2$, the supply voltage $V_{sup}$ again starts to increase towards the target value $V_{sup1}$ (which may, for example, be defined by the reference voltage information). Starting from time $t_3$, the digital regulator may also become active, and may fine-regulate the supply voltage $V_{sup}$ towards the desired value $V_{sup1}$.

To conclude, right after the load step, the voltage drop is primarily limited by a capacitance which is circuited in parallel with the load. However, the inner analog control loop becomes effective significantly before the digital regulator becomes effective. The inner analog control loop is typically capable to limit a voltage drop to an acceptable value, but typically cannot fully bring the supply voltage back to the desired value $V_{sup1}$. This is, partly, due to the fact that the inner analog control may, for example, only provide a proportional control functionality and may not bring along an integral control functionality. However, the digital regulator may, finally, perform a very precise regulation of the supply voltage, for example, using an integral control component, and may consequently bring back the supply voltage to the desired value $V_{sup1}$ (or very close to the desired value) after a certain amount of time. Thus, the inner analog control loop and the digital regulator may supplement each other to provide a good supply voltage regulation both shortly after a load step and in a steady state.

It should be noted that the behavior of the power supply 100, which is described taking reference to FIG. 2, may, for example, be achieved by the fact that the bandwidth of the inner analog control loop is larger (for example, by a factor of 5, or a factor of 10 or a factor of 20) than a bandwidth of the digital regulator 130. The functionality may also be achieved by the fact that a bandwidth of the inner analog control loop is higher than a tenth of the sampling rate of an analog-to-digital converter which provides the measured voltage information 134 for the digital regulator.

For example, the fast reaction of the inner analog control loop may be achieved by the fact that the inner analog control loop may be configured to perform a proportional control (or a proportional control only). In contrast, the digital regulator may comprise a more advanced control functionality. For example, the digital regulator 130 may perform a closed loop control which comprises an integral control. As an example, the digital regulator 130 may be configured to perform a proportional-integral regulation or to perform a proportional-integral-differential regulation (PID-regulation). However, the digital regulator 130 may also perform different control functionalities and may even comprise a non-linear regulation characteristic.

Moreover, it should be noted that, optionally, the digital regulator may be reconfigurable, since the control functionality (or control mechanism, or control algorithm) which is performed by the digital regulator 130 may be defined by software, which can be amended and adapted to the specific requirements. Thus, the digital regulator 130 may be more flexible in terms of its configuration when compared to the inner control loop that provides an analog closed loop control contribution. As outlined above, the inner analog control loop may counter-act a supply voltage variation (for example, a supply voltage drop or a supply voltage overshoot) caused by a change of the current consumption of the load coupled to the power supply (for example, via a load connection 112). For example, the inner analog control loop may be fast enough to counteract the supply voltage variation even before the digital regulation becomes active.

As outlined above, a drop of the supply voltage (as shown in FIG. 2 of a time $t_1$) may result in an increase of the supply current $I_{SUP}$, which may initially be caused by the feedback via the inner analog control loop.

However, it should be noted that any of the other features, functionalities and the details disclosed herein may optionally be also applied in the power supply 100. On the other hand, any of the features, functionalities and details described with respect to the power supply 100 may optionally be introduced into any of the other embodiments disclosed herein.

Figure 3:
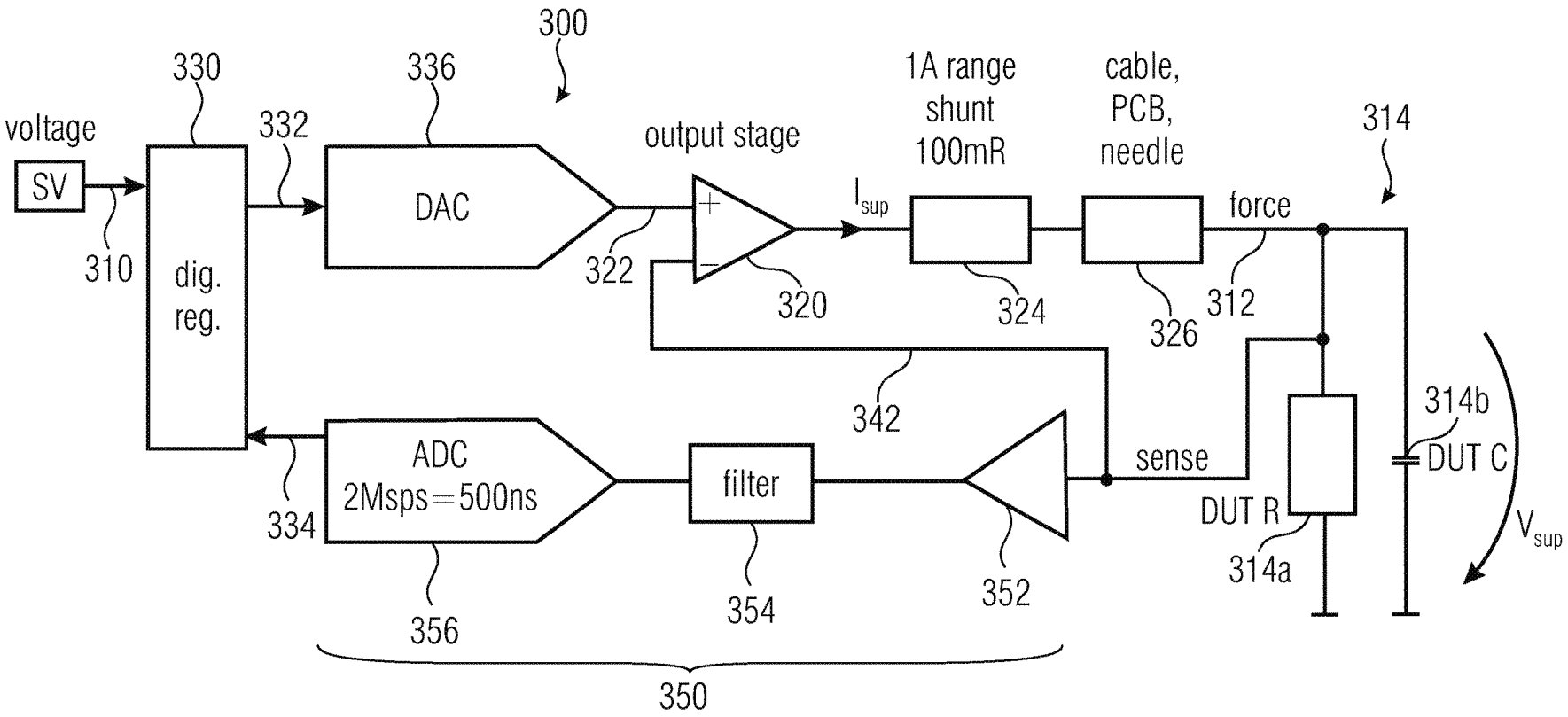
FIG. 3 shows a block schematic diagram of a digital control with an inner analog loop, according to another embodiment of the present invention.

5.2 Embodiment According to FIG. 3

FIG. 3 shows a block schematic diagram of a power supply 300, according to another embodiment of the present invention.

The power supply 300 is configured to receive a reference voltage information or desired voltage information 310 and to provide, on the basis thereof, a supply voltage $V_{sup}$ to a load 314, which may be coupled to a load connection 312. The load 314 may, for example, comprise a device under test or, generally speaking, a first load component 314*a*, which is represented by a resistor. However, it should be noted that the load component 314*a* does not necessarily need to be a resistor, but may, for example, be an integrated circuit. Moreover, the load 314 may, for example, also comprise (e.g. as a second load component) a capacitance 314*b*, which may be circuited in parallel to the first load component or device under test 314*a*. For example, the capacitance 314*b* may be useful to avoid an abrupt change of the supply voltage $V_{sup}$ in the case of a "load step", i.e., in the case that the load component 314 suddenly changes its current consumption. Such a sudden change of the current consumption may, for example, occur when the load component 314*a* is activated or instructed to perform a power consuming operation (for example, following an idle state).

However, it should be noted that the load 314 is typically not part of the power supply 300, but coupled to the power supply via a load connection 312.

The power supply 300 comprises, as an important component, an output stage 320, which may, for example, provide a supply current $I_{sup}$ in dependence on an analog control signal 322 and an analog feedback signal 342.

For example, the output stage 320 may comprise a control amplifier or difference amplifier or operational amplifier, such that the supply current $I_{sup}$ may, for example, be determined by a difference between the analog control signal 322 and the analog feedback signal 342.

For example, the output stage 320 may comprise one or more power semiconductor devices which provide the supply current $I_{sup}$ in dependence on one or more drive signals, wherein said one or more drive signals for the one or more power semiconductor devices may be determined in dependence on the analog control signals 322 and the analog feedback signal 342 (for example, in dependence on a difference between the analog control signal 322 and the analog feedback signal 342). Moreover, it should be noted that an output of the output stage 320 may, for example, be coupled with the load connection 312 via a shunt resistor 324 and a connection 326.

The shunt resistor 324 may, for example, comprise a value of 100 Milliohm for a 1 A range. In other words, the shunt resistor 324 may be provided to generate a voltage drop which is proportional to the supply current $I_{sup}$, to allow for a current measurement. However, it should be noted that the shunt resistor 324 may be considered as being optional, and that different values of the shunt resistor may also be used.

The connection 326 may, for example, comprise a cable and/or a trace on a printed circuit board and/or one or more needles (for example, spring-loaded needle contacts). However, it should be noted that any type of electrical connection may be used to connect the output of the output stage 320 with the load connection 312.

Moreover, it should be noted that the power supply 300 also comprises a digital regulator 330, which receives the reference voltage information 310 (e.g., "SV") and also a measured voltage information 334. The digital regulator 330 provides a digital control signal or digital control information 332 on the basis of the reference voltage information 310 and the measured voltage information 334 to a digital-analog-converter 336. The digital-to-analog converter 336 may provide the analog control signal 322 on the basis of the digital control signal 332.

It should be noted that the digital regulator 330 may use any regulation mechanism or regulation algorithm. For example, the digital regulator 330 may use a regulation mechanism or regulation algorithm which comprises an integral control. However, in addition, the digital regulator 330 may preferably also use a proportional control component, and optionally may also use a differential control component. For example, the digital regulator 330 may be configured to perform a PI control functionality or a PID control functionality (wherein PI means proportional-integral, and wherein PID means proportional-integral-differential).

The measured voltage information 334 may be provided to the digital regulation 330 via a feedback path 350. The feedback path 350 may, for example, comprise a buffer 352, a filter 354 and an analog-to-digital converter 356. For example, the feedback path 350 may be between a terminal of the load 314 or of the first load component 314*a* and the digital regulation 330. The feedback path 350 may, for example, comprise a buffer 352, which avoids that the filter 354 affects the supply voltage $V_{sup}$ or the current measurement. For example, an input of the buffer 352 is coupled to a terminal of the load 314 or of the first load component 314*a*, and an output of the buffer 352 is coupled to an input of the filter 354. The filter 354 may, for example, comprise a lowpass characteristic, to avoid aliasing artifacts. However, the filter 354 may also help to reduce a noise for the analog-to-digital conversions. An output of the filter 354 may be coupled to an input of the analog-to-digital converter 356, which may, for example, analog-to-digital convert the output signal of the filter 354. Moreover, a digital output information provided by the analog-to-digital converter on the basis of its input signal may constitute the measured voltage information 334, and may be input into the digital regulation 330.

Thus, the digital regulation 330 may receive a filtered and analog-to-digital converted representation of the supply voltage, which is present at the load 314, or at the first load component 314*a*, as the measured voltage information 334.

However, it should be noted that the buffer 352 and the filter 354 may be considered as being optional, and that the input of the analog-to-digital converter 356 could, for example, be coupled directly to a terminal of the load 314 or of the first load component 314*a*.

However, the power supply 300 also comprises an inner analog control loop, which is formed by feeding the analog feedback signal 342 to the output stage 320. In other words, an input of the output stage 320 may be directly coupled (for example, without any additional filters and/or without any intermediate digital processing) to a terminal of the load 314 or of the first load component 314*a*. Thus, the analog feedback signal 342 may represent the supply voltage which is present at the load 314 or at the first load component 314*a*. Yet worded differently, both the measured voltage information 334 and the analog feedback signal 342 may represent the supply voltage $V_{sup}$ present at the load 314 or at the load component 314*a*, but it is apparent that the analog feedback signal 342 follows changes of the supply voltage $V_{sup}$ much faster than the digital measured voltage information 334 which is input into the digital regulator 330, because the analog feedback signal 342 avoids the comparatively slow analog-to-digital conversion process performed by the analog-to-digital converter 356 (and typically also does not undergo a filtering).

Regarding the functionality of the power supply 300, it should be noted that, due to the presence of the inner analog control loop, the supply current $I_{sup}$ can be quickly increased in response to a drop of the supply voltage $V_{sup}$, wherein a speed of the reaction (increase of the supply current $I_{sup}$) is only limited by an inertia of a regulation amplifier of the output stage and of the power semiconductor devices of the output stage. Thus, right after a load step, a regulation (e.g., an increase of the supply current $I_{sup}$) is effected by the inner analog control loop. Worded differently, in response to a load step, there is a comparatively high propagation time until a resulting variation of the supply voltage $V_{sup}$ is reflected by the measured voltage information 334. There is an even larger delay until a variation of the supply voltage is reflected in the digital control signal 332 or even in the analog control signal 322 because of the delays imposed by the analog-to-digital converter 356, the digital regulator 330 and the digital-to-analog converter 336. Thus, right after a variation (e.g., drop) of the supply voltage (which occurs in response to a load step), the analog control signal 322 still remains constant, but the analog feedback signal 342 already reflects the supply voltage variation. Since the supply current $I_{sup}$ may, for example, be determined by the difference between the analog control signal 322 and the analog feedback signal 342, the supply current $I_{sup}$ may be changed very fast in response to a variation of the supply voltage due to the presence of the inner analog control loop. In particular, the supply voltage $I_{sup}$ may be changed, due to the presence of the inner analog control loop, even before the analog control signal 322 exhibits a response to the variation of the supply voltage. Thus, a reaction to the variation of the supply voltage $V_{sup}$ (e.g., in the form of an appropriate variation of the supply current $I_{sup}$) is significantly accelerated by the presence of the inner control loop without having the need to reduce a latency of the digital regulation loop (or a digital control loop). However, as time goes by, the digital regulation 330 also becomes effective, and may result in a more accurate regulation of the supply voltage than it is possible using the inner analog control loop only.

In view of the above discussion, it is apparent that the presence of the inner analog control loop brings along a significant advantage.

However, it should be noted that the power supply according to FIG. 3 may comprise a similar regulation characteristic as it has been described taking reference to FIG. 2.

Moreover, it should be noted that the power supply 300 may optionally be supplemented by any of the features, functionalities and details disclosed herein, both individually and taken in combination.

In addition, it should be noted that the power supply 300 (as well as the power supply 100) may, for example, be used in automated test equipment, wherein a device under test may take the role of the load 300 or of the first load component 314*a*. In this case, the capacitance 314*b* may be part of the power supply, and/or may be arranged on a load board which carries the DUT. The reference voltage information 310 may, for example, be provided by a control circuit of the automated testing equipment, and a temporal evolution of the reference voltage information 310 may, for example, be determined by a test program.

Figure 4:
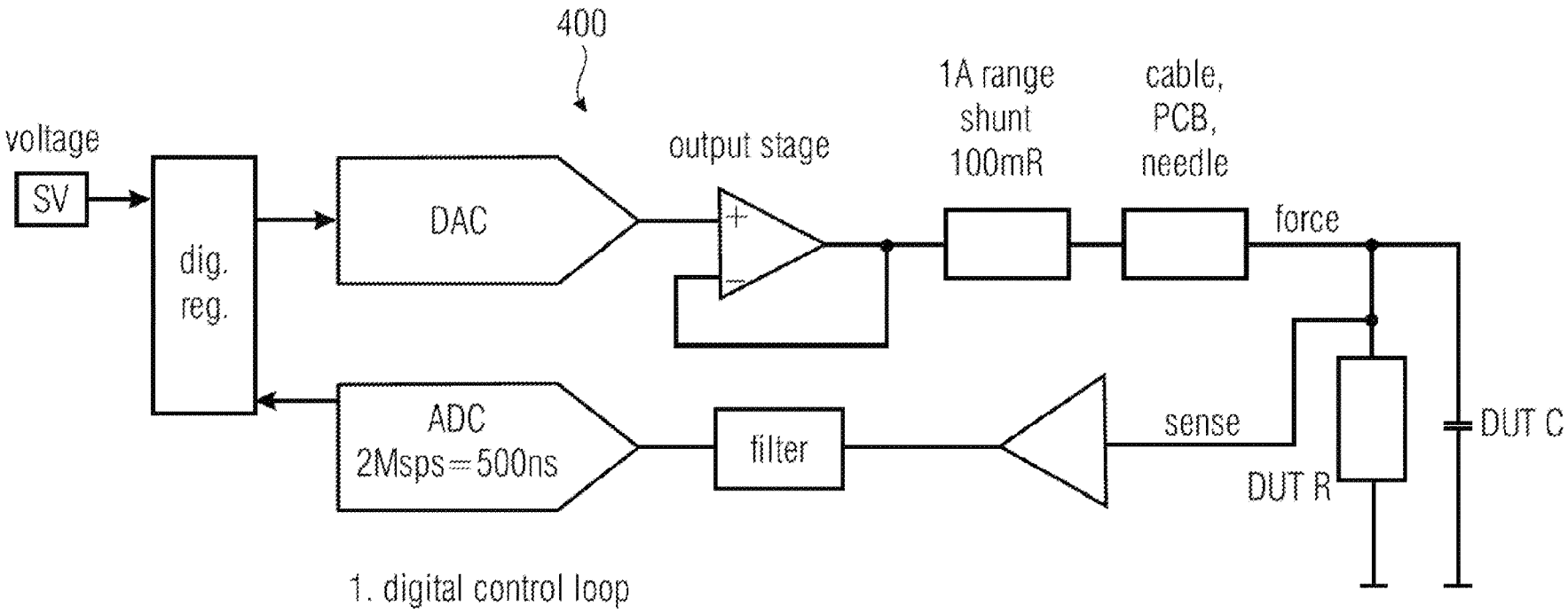
FIG. 4 shows a block schematic diagram of a conventional digital control loop.

5.3 Reference Example According to FIG. 4

FIG. 4 shows a block schematic diagram of a reference power supply 400. However, it should be noted that the reference power supply 400 is similar to the power supply 300, except for the fact that there is no inner analog control loop. Accordingly, a reaction of the reference power supply 400 to a change of the supply voltage is typically significantly slower than a reaction of the power supply 300 to a variation of the supply voltage.

5.4 Conclusions

It should be noted that embodiments according to the invention create a load step improvement for digital control loop based power supplies or DUT power supplies.

According to embodiments of the present invention, an additional inner analog control loop is added to a digital control loop based VI source or DUT power supply using a single control loop. With the additional inner analog control loop, the load step behavior is improved significantly. In other words, embodiments according to the invention solve the problem to improve the load step behavior. For example, a standard approach has a drop voltage at the output of some 100 millivolt, and it takes about 100 μs to come back to the voltage (or to the desired supply voltage). With an inner feedback loop (or an inner analog feedback loop), the load step can be improved to 20 millivolt, and it takes only a few 1 μs (e.g. until a regulation becomes active, or until a voltage is brought back into a tolerable range).

Embodiments according to the present invention do not need very high sample rates of the voltage measurement analog-to-digital converter (e.g. of the analog-to-digital converter 356). For example, voltage precision may be given by the digital regulator, and a high speed regulation loop (or, generally speaking, a high speed regulation) is given by the local analog control loop (or inner analog control loop).

To conclude, it is a basic idea of the present invention (or of embodiments according to the present invention) to combine a digital control loop with an inner high speed control loop.

Details regarding the construction and operation of embodiments are shown, for example, in FIGS. 1, 2 and 3.

To conclude, a power supply concept has been disclosed which combines the advantages of different regulation concepts. The digital regulator is typically very flexible, and it is, for example, possible to adjust a bandwidth and/or a regulation characteristic. However, the inner analog control loop, which typically comprises an analog control amplifier, is typically significantly faster than the digital regulator. In some embodiments, the inner analog control loop is at least 10 times faster than the digital regulator (or than the digital control loop comprising the digital regular). For example, a bandwidth of the inner analog control loop is at least 10 times larger than a bandwidth of an (outer) digital control loop comprising the digital regulator. As an example, the digital regulator may have a bandwidth of approximately 50 kHz, or of the order of 50 kHz, while the inner analog control loop may have a bandwidth in a range between 500 kHz and 1 MHz.

Moreover, the inner analog control loop may only comprise a pure proportional regulator (while the outer digital control loop may also comprise an integral regulator component). An input of the analog regulation amplifier (which may be part of the output stage) may, for example, be directly coupled with the output of the power supply or with the load connection of the power supply. This direct connection may result in a particularly high bandwidth of the analog regulation.

To conclude, embodiments according to the invention provide a good tradeoff between complexity and regulation characteristics.

The invention claimed is:

1. A power supply comprising:

an output stage configured to provide a supply current (Isup) to obtain a supply voltage (Vsup);

a digital regulator configured to receive a reference voltage information, and a measured voltage information and further configured to provide a control signal; and an inner analog control loop configured to provide an analog feedback signal based on the supply voltage (Vsup), wherein the analog feedback signal is provided to the output stage as an analog regulation contribution to a regulation of the supply voltage, wherein the inner analog control loop is configured to supply a drive signal for the output stage that is based on a subtraction between the control signal provided by the digital regulator and the analog feedback signal comprising the supply voltage (Vsup), wherein the inner analog control loop is further configured to perform a proportional control, and wherein the digital regulator is configured to perform a closed loop control which comprises an integral control, wherein a bandwidth of the inner analog control loop is larger than a bandwidth of the digital regulator.

2. The power supply according to claim 1, wherein the bandwidth of the inner analog control loop is larger at least by a factor of 5 than the bandwidth of the digital regulator.

3. The power supply according to claim 1, further comprising an analog-to-digital converter and wherein a bandwidth of the inner analog control loop is higher than a tenth of a sampling rate of the analog-to-digital converter which is configured to provide the measured voltage information for the digital regulator.

4. The power supply according to claim 1, wherein a control mechanism of the digital regulator is reconfigurable.

5. The power supply according to claim 1, wherein the inner analog control loop is configured to reduce a supply voltage variation caused by a change of current consumption of a load coupled to the power supply before the digital regulation becomes effective.

6. The power supply according to claim 1, wherein the inner analog control loop is configured wherein a drop of the supply voltage ($V_{sup}$) results in an increase of the supply current ($I_{sup}$).

7. The power supply according to claim 1, wherein the inner analog control loop comprises a feedback of one of the supply voltage ($V_{sup}$); and an analog signal which is based on the supply voltage ($V_{sup}$).

8. The power supply according to claim 1, further comprising:

a feedback path for the digital regulator;

a digital-to-analog converter configured to provide an analog control signal based on digital control information provided by the digital regulator; and an analog regulator configured to receive the analog control signal provided by the digital-to-analog converter and the analog feedback signal comprising the supply voltage ($V_{sup}$), and further configured to provide the drive signal for the output stage based on the analog control signal provided by the digital-to-analog converter and the analog feedback signal, wherein the analog regulator is comprised within the output stage and comprises a difference amplifier or an operational amplifier.

9. The power supply according to claim 8, wherein the feedback path for the digital regulator comprises an analog-to-digital converter and a filter, and wherein the filter is coupled between a load connection and an input of the analog-to-digital converter.

10. The power supply according to claim 9, wherein the feedback path for the digital regulator comprises a buffer coupled between the load connection and the filter.

11. The power supply according to claim 1, further comprising:

a shunt resistor for a current measurement wherein the shunt resistor is coupled between the output stage and a load connection.

12. A method of supplying power the method comprising:

providing a supply current using an output stage operable to generate a supply voltage;

receiving reference voltage information and measured voltage information by using a digital regulator;

providing a control signal using the digital regulator; and providing an analog feedback signal using an inner analog control loop wherein the analog feedback signal is provided to the output stage, wherein the analog feedback signal is based on the supply voltage, and wherein further the analog feedback signal makes an analog regulation contribution to a regulation of the supply voltage, wherein the inner analog control loop is configured to supply a drive signal for the output stage that is based on a subtraction between the control signal provided by the digital regulator and the analog feedback signal comprising the supply voltage (Vsup), wherein the inner analog control loop is further configured to perform a proportional control, and wherein the digital regulator is configured to perform a closed loop control which comprises an integral control, wherein a bandwidth of the inner analog control loop is larger than a bandwidth of the digital regulator.

13. The method of claim 12, wherein the bandwidth of the inner analog control loop is larger by at least a factor of 10 than the bandwidth of the digital regulator.

14. The method of claim 12, wherein a bandwidth of the inner analog control loop is higher than a tenth of a sampling rate of an analog-to-digital converter configured to provide the measured voltage information for the digital regulator.

15. The method of claim 12, further comprising:

performing a proportional control using the inner analog control loop; and performing a closed loop control comprising an integral control using the digital regulator.

16. The method of claim 12, wherein a control mechanism of the digital regulator is reconfigurable.

17. The method of claim 12 wherein the inner analog control loop is configured wherein a drop of the supply voltage results in an increase of the supply current.

* * * * *